US007080611B2

(12) United States Patent
Chosei

(10) Patent No.: US 7,080,611 B2
(45) Date of Patent: Jul. 25, 2006

(54) ENGINE-DRIVEN WORK MACHINE

(75) Inventor: Noboru Chosei, Fukui-Ken (JP)

(73) Assignee: Denyo Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/800,658

(22) Filed: Mar. 16, 2004

(65) Prior Publication Data

US 2005/0155559 A1 Jul. 21, 2005

(30) Foreign Application Priority Data

Jan. 19, 2004 (JP) ..... 2004-010258

(51) Int. Cl.
*F01P 1/00* (2006.01)

(52) U.S. Cl. ..... 123/41.56

(58) Field of Classification Search ..... 123/41.56, 123/41.7, 41.65

See application file for complete search history.

(56) References Cited

U.S. PATENT DOCUMENTS 4,608,946 A * 9/1986 Tanaka et al. ..... 123/2
4,622,923 A * 11/1986 Nishimura et al. ..... 123/2
4,907,546 A * 3/1990 Ishii et al. ..... 123/41.56
5,121,715 A * 6/1992 Nogami et al. ..... 123/41.7
5,642,702 A * 7/1997 Kouchi et al. ..... 123/198 E
5,899,174 A * 5/1999 Anderson et al. ..... 123/2
6,230,667 B1 * 5/2001 Stauffer et al. ..... 123/2
6,492,740 B1 * 12/2002 Suzuki ..... 290/1 A
6,775,981 B1 * 8/2004 Fukuda et al. ..... 60/597

FOREIGN PATENT DOCUMENTS

JP 61-169229 10/1986
JP 08-223854 8/1996
JP 2003-293771 10/2003

* cited by examiner

*Primary Examiner*—Henry C. Yuen
*Assistant Examiner*—Jason Benton
(74) *Attorney, Agent, or Firm*—Jacobson Holman PLLC

(57) ABSTRACT

An engine-driven work machine enables the work machine and its electrical components to be properly cooled. An engine-driven work machine comprises an engine, a work machine driven by an engine, and electrical components belonging to the work machine, and supplies an output for work while being driven by the engine; the engine-driven work machine has an open machine accommodating section, which is provided in a main body of the work machine and accommodates an engine and a work machine driven by the engine, and a control box for accommodating part of the engine, electrical components of the work machine, and a fuel tank; the control box is provided above the machine accommodating section, and has a ventilation path that connects to a fan fitted to the engine, the electrical components and the fuel tank being arranged along the ventilation path.

3 Claims, 2 Drawing Sheets

ENGINE-DRIVEN WORK MACHINE

BACKGROUND OF THE INVENTION

1. Field of the Invention

This invention relates to an engine-driven work machine, which is driven by an engine while performing work, and more particularly relates to a transportable engine-driven work machine such as an electric power generator, a welding machine, and the like.

2. Description of the Related Art

Examples of this type of engine-driven work machine include an engine-driven electric power generator, a welding machine, and the like. In these types of machines, heat discharged from the engine and from the electrical components must be processed; it is particularly important to ensure that heat discharged from the engine does not damage the electrical components.

To achieve this, the engine is separated from the electrical components by using a heat-cutoff cover or the like, preventing heat discharged from the engine from heading toward the electrical components. Patent Documents Nos. 1 to 3 describe examples of such a structure.

In the engine-driven work machines disclosed in the Japanese Patent Documents (Japanese Utility model Laid-open No. 1986-169229, Japanese Patent Laid-Open No. 1996-223854 and Japanese Patent Laid-Open No. 2003-293771), the engine and the electrical components are accommodated inside a case or a cover, and a cooling wind is applied separately to the engine and the electrical components.

In these machines, since far greater heat is generated by the engine than by the electrical components, the cooling device is chiefly designed for cooling the engine, and in addition cools the electrical components.

However, as a result of increasing the capacity of the power elements when increasing the capacity of the machine, it becomes much more important to cool the electrical components. It is not sufficient to apply a cooling wind to the electrical components by using a fan, which is generally provided inside work machines.

SUMMARY OF THE INVENTION

This invention has been realized in view of the above points, and aims to provide an engine-driven work machine in which the work machine and its electrical components can be properly cooled.

In order to achieve these objects, in a first aspect, this invention provides an engine-driven work machine comprising an engine, a work machine driven by an engine, and electrical components belonging to the work machine, the engine-driven work machine supplying an output for work while being driven by the engine. The engine-driven work machine comprises an open machine accommodating section, which is provided in a main body of the work machine and accommodates an engine and a work machine driven by the engine; and a control box for accommodating part of the engine, electrical components of the work machine, and a fuel tank, the control box being provided above the machine accommodating section, and having a ventilation path that connects to a fan fitted to the engine, the electrical components and the fuel tank being arranged along the ventilation path.

In a second aspect of this invention, in the engine-driven work machine of the first aspect, the electrical components that generate low heat are provided upstream on the ventilation path, and those that generate considerable heat are provided downstream.

In a third aspect of this invention, in the engine-driven work machine of the first aspect, the ventilation path is connected to an engine cooling air passage of the work machine and a muffler cooling air passage.

In a fourth aspect of this invention, in the engine-driven work machine of the first aspect, the inlet of the ventilation path is provided in the bottom face of the control box.

In a fifth aspect of this invention, in the engine-driven work machine of the fourth aspect, the cross-sectional area of the ventilation path decreases as its distance from the inlet increases.

This invention obtains the following effects.

According to the invention of the first aspect, the engine and the work machine driven by the engine are accommodated in an open machine accommodating section, and the electrical components and the fuel tank are arranged along a ventilation path, which is ventilated by a fan of an engine inside a control box provided above the machine accommodating section, thereby properly cooling the work machine and its electrical components.

According to the invention of the second aspect, the electrical components are arranged in sequence along the ventilation path such that components generating low heat precede those generating considerable heat, so that the electrical components that particularly require cooling can be cooled reliably.

According to the invention of the third aspect, the ventilation path for cooling the electrical components connects to a ventilation path for cooling the engine and the work machine, and also to a muffler cooling air ventilation passage; therefore, the electrical components can be cooled without being affected by heat from the engine, making the cooling more effective.

According to the invention of the fourth aspect, the inlet of the ventilation path is provided in the bottom face of the control box, thereby preventing rainwater from seeping into the inlet and preventing trouble when the machine is used outdoors.

According to the invention of the fifth aspect, the cross-sectional area of the ventilation path decreases as its distance from the inlet increases, reducing the suction speed at the inlet and preventing rain from seeping in.

DESCRIPTION OF THE PREFERRED EMBODIMENT

A preferred embodiment of the invention will be explained with reference to FIGS. 1 to 3.

Figure 1:
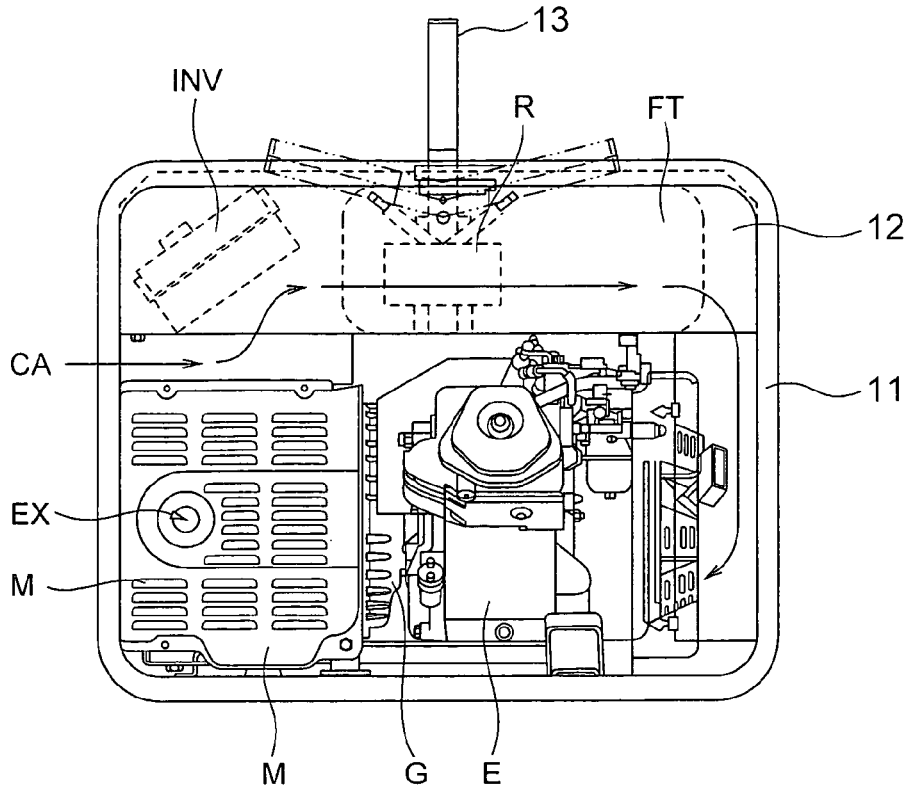
FIG. 1 is a diagram showing the internal constitution of an embodiment of this invention from the rear side.

FIG. 1 is a diagram showing the internal structure of a first embodiment of this invention viewed from the side. This embodiment has a pipe frame structure, wherein the large constituent components such as an engine E and muffler M are attached below a pipe frame 11, a control box 12 is provided above the pipe frame 11, and electrical components comprising an inverter INV and a reactor R are accommodated with a fuel tank FT inside the control box 12.

The control box 12 also functions as a duct for ventilating cooling air against the electrical components. An inlet for the cooling air CA is provided in the bottom section of the control box 12, that is, from the left side of FIG. 1 over a dividing wall above an electric power generator G at the bottom section of the pipe frame 11. This prevents rainwater from entering the inlet when the engine-driven work machine is operating in rainy conditions.

The cooling air CA enters the control box 12 through the inlet in the bottom of the control box 12, passes through the inverter INV, around the fuel tank FT and the reactor R, proceeds to the bottom section of the pipe frame 11, and is finally absorbed into the fan of the engine E and is used to cool the engine E and the muffler M; the cooling air CA is discharged outside the machine toward the front of FIG. 1 from a discharge hole M', provided at the front side of the muffler M as shown in FIG. 1.

Midway, the cross-sectional area of the ventilation path gradually decreases as the distance from the inlet increases, reducing the suction speed at the inlet. As a result, rain can be prevented from seeping in through the inlet.

A collapsible sling fitting 13 is provided above the center of the control box 12 on the pipe frame 11, and enables the entire work machine to be moved by a crane or the like.

Figure 2:
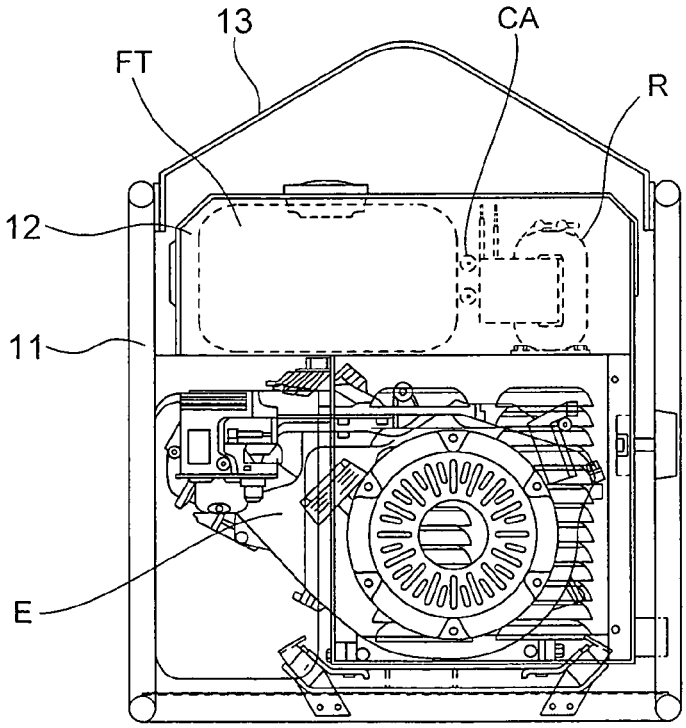
FIG. 2 is a diagram showing the constitution of FIG. 1 from the left side.

FIG. 2 shows a view of the work machine of FIG. 1 from the right side. The engine E is in the bottom section of the pipe frame 11, and the fuel tank FT is provided in the control box 12 above on the left side, with the reactor R on the right side.

The cooling air CA flows through the space between the fuel tank FT and the reactor R toward the front of FIG. 2.

Figure 3:
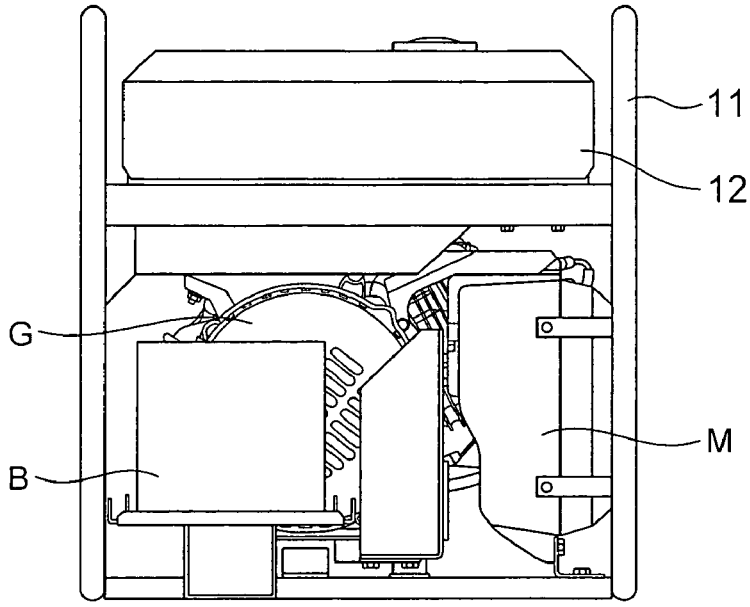
FIG. 3 is a diagram showing the constitution of FIG. 1 from the right side.

FIG. 3 shows the work machine of FIG. 1 from the left side. The fuel tank FT is at the top section of the pipe frame 11, and the muffler M is at the bottom section on the right side; an electric power generator G is provided behind a battery B on the left side at the front.

In addition to the cooling air CA from the fan of the engine E shown in FIG. 1, cooling air from a fan fitted to the electric power generator G cools the battery B, then cools the electric power generator G, and is thereafter discharged into the atmosphere.

Figure 4:
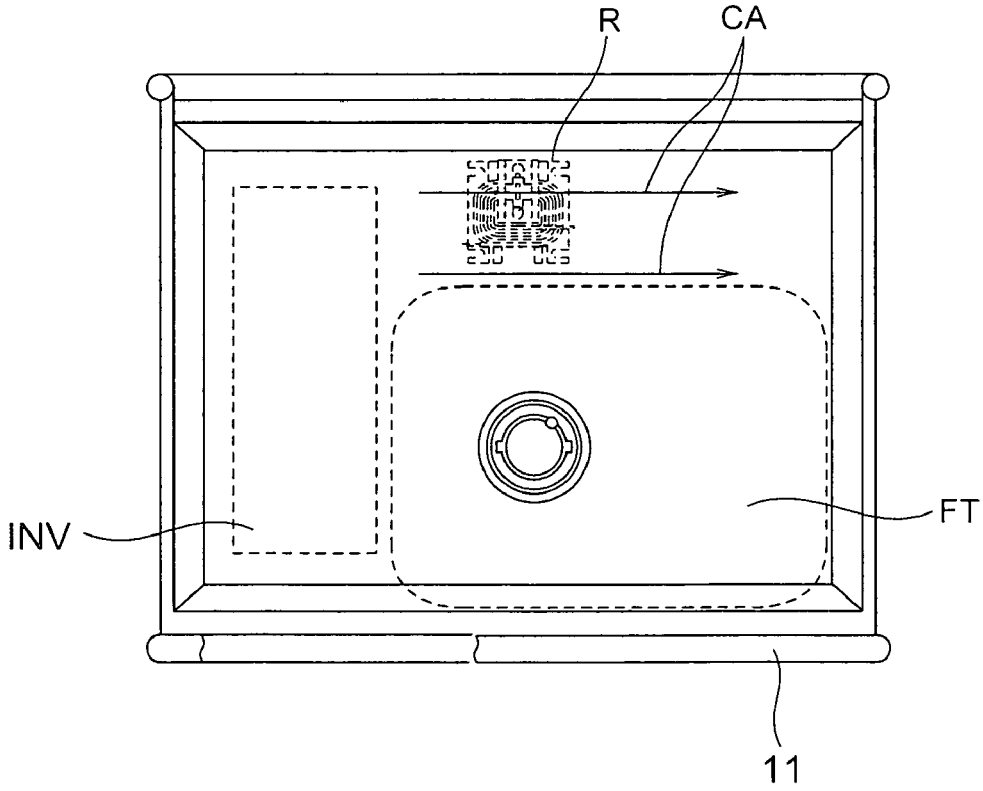
FIG. 4 is a diagram showing the constitution of FIG. 1 from the top side.

FIG. 4 shows a plan view of the inside of the control box 12, the inverter INV being positioned at the left side of FIG. 4, the fuel tank FT at the bottom side, and the reactor R at the top side.

The cooling air CA travels from below the inverter INV through the cooling fin of the inverter, from the left side of FIG. 4 to the right side, between the fuel tank FT and the reactor R, and thereafter flows along the outer shape of the control box 12 to the bottom section of the pipe frame 11.

As described in FIGS. 1 to 3, air from the outside enters the control box 12, cools the inverter INV, and then cools the fuel tank FT and the reactor R.

After cooling the inverter INV, which has a low permissible temperature and a small temperature rise, the cooling air CA subsequently cools the reactor R and the fuel tank FT, which have high permissible temperatures and large temperature rises.

This cooling sequence keeps the temperature of the cooling air CA low for subsequently directing it against the reactor R and the fuel tank FT, enabling them to be cooled adequately.

After being warmed by heat from the various components in the control box 12, the cooling air CA is captured in the fan of the engine E at the bottom left side of FIG. 1, i.e. the position farthest from the capture hole of the cooling air, cools the engine E and the muffler M that is connected to the engine E, and is discharged into the atmosphere. Therefore, the cooling air does not re-enter the work machine once it has been discharged.

Since the bottom section of the pipe frame 11 is open, the electric power generator G, the battery B, and the like, in this bottom section are cooled by driving an electric power generator fan of the electric power generator G, which is directly coupled to the engine E. That is, cooling air absorbed from the battery B side cools the battery B, then cools the electric power generator G, and is thereafter discharged into the atmosphere. Therefore, when the engine E and the electric power generator G are operating, their (not illustrated) fans start to revolve, sending cooling air around them and effectively cooling them.

In the embodiment described above, an inverter is included as an electrical component for which cooling is important, and cooling air is directed to its cooling fin; the cooling efficiency of this cooling fin can be increased by using a heat-radiating aluminum heating sink, or the like.

Some engine-driven work machines, such as welding machines, have reactors among their electrical components, whereas others, such as electric power generators, do not; the constitution of the ventilation path and the arrangement of the electrical components differs accordingly.

A second inlet may be provided in the control box on the engine fan side, giving priority to cooling the engine.

What is claimed is:

1. An engine-driven work machine comprising an engine, a work machine driven by the engine, and electrical components belonging to the work machine, the engine-driven work machine supplying an output for work while being driven by the engine, and comprising:

an open air machine accommodating section provided in a main body of the work machine and accommodating the engine and the work machine driven by the engine and a fan capturing cooling air via a ventilation path having an inlet; and a control box for accommodating part of the engine, the electrical components of the work machine, and a fuel tank, the control box being provided above the open air machine accommodating section, and having the ventilation path connecting the fan to the engine, the electrical components and the fuel tank being arranged along the ventilation path, the electrical components generating low heat being provided upstream on the ventilation path, and the engine generating considerable heat being provided downstream on the ventilation path, a cross sectional area of the ventilation path decreasing as a distance from the inlet increases.

2. The engine-driven work machine as described in claim 1, wherein the ventilation path is connected to an engine cooling air passage of the work machine and a muffler cooling air passage.

3. The engine-driven work machine as described in claim 1, wherein the inlet of the ventilation path is provided in the bottom face of the control box.

* * * * *